United States Patent [19]

Fast

[11] Patent Number: 4,882,868

[45] Date of Patent: Nov. 28, 1989

[54] PRODUCT INFORMATION TAG WITH SPECIALIZED MOUNTING PORTION

[76] Inventor: Jacob Fast, 7561 NW. 9th St., Plantation, Fla. 33317

[21] Appl. No.: 326,792

[22] Filed: Mar. 21, 1989

[51] Int. Cl.[4] ..... A47G 29/10

[52] U.S. Cl. ..... 40/657; 40/642; 40/124.4; 211/59.1

[58] Field of Search ..... 40/642, 657, 124, 124.1, 40/124.4, 539; 248/220.2, 220.4, 222.2; 211/57.1, 59.1

[56] References Cited

U.S. PATENT DOCUMENTS

| | | | |
|---|---|---|---|
| 4,525,944 | 7/1985 | Fast | 40/124.1 |
| 4,646,454 | 3/1987 | Fast | 40/124.1 |
| 4,665,639 | 5/1987 | Fast | 40/124.4 |
| 4,693,024 | 9/1987 | Fast | 40/20 R |
| 4,698,929 | 10/1987 | Fast | 40/124.1 |
| 4,703,570 | 11/1987 | Fast | 40/19.5 |
| 4,773,172 | 9/1988 | Fast | 40/657 |

*Primary Examiner*—Gene Mancene
*Assistant Examiner*—Michael Lynch
*Attorney, Agent, or Firm*—Fleit, Jacobson, Cohn, Price, Holman & Stern

[57] ABSTRACT

A product information and display tag for presenting product information at the forward end of a horizontal product suspension hook has a mounting portion specifically designed for use with a particular type of hook known as a Snaplock Slat hook which has a plastic bracket at its proximal end for releasably securing the hook on a slatted wall panel. The mounting portion of the tag has an opening through which the bracket is partially inserted in order to secure the tag on the bracket, and the width of the opening is sufficient to preclude the tag from working off the bracket when in use.

6 Claims, 2 Drawing Sheets

PRODUCT INFORMATION TAG WITH SPECIALIZED MOUNTING PORTION

BACKGROUND OF THE INVENTION

This invention relates to product information tags for use with merchandise which is suspended from elongate horizontally oriented support hooks and the like. More particularly, the invention relates to such tags which may be readily attached to and removed from a support hook without being subject to inadvertent removal, and which display product information forwardly of merchandise supported on a hook.

Information tags of the above type are quite well known, and examples of such tags are disclosed for example, in my prior U.S. Pat. Nos. 4,525,944; 4,646,454; 4,692,929; 4,703,570; 4,665,639 and 4,715,135.

The tags disclosed in the afore-noted patents generally comprise an elongate plastic strip including a rear-end mounting portion by which the tag is secured at a proximal end of a support hook, an intermediate body portion which extends over the merchandise on the hook, and a forward end display portion at the front of the hook on which the product information may be displayed by way of an adhesive label or the like. Depending, inter alia, on the type of hook with which the tag is to be used, the known tags have various different designs of mounting portion, and likewise, depending on application, have different designs of body portion and display portion.

SUMMARY OF THE INVENTION

The present invention relates to a tag of the kind described which has a mounting portion particularly suited for use with a particular form of product display hook, notably a hook referred to as a "Snaplock Slat Hook" which is sold by Pentapco Inc., 963 Newark Avenue, Elizabeth, N.J. 0727 and which attaches to a "Mini Slat" (Trademark) wall panel sold by the same corporation.

A "Mini Slat" wall panel is a plastic panel which attaches to a vertical wall or display in a store or the like and has an array of superimposed horizontal channels into which one or more of the "Snaplock" hooks can be fitted. A "Snaplock" hook structure includes a plastic back bracket particularly designed to fit into one of the aforesaid channels and a separable wire rod (constituting the "hook" itself) which fits into the bracket.

Pentapco Inc. also markets a product information tag of the general kind described for use with the "Snaplock" hooks, such tag having a mounting portion specifically designed to fit on the hook. It is found in practice, however, that this tag when fitted, may tend to be somewhat loose and unstable.

The present invention provides a product information tag of the kind previously described, which has a mounting portion specifically designed to fit on a "Snap lock" hook bracket and secure the tag thereon in a tighter and more stable manner.

DESCRIPTION OF THE PREFERRED EMBODIMENT

Figures 1, 2, 3:
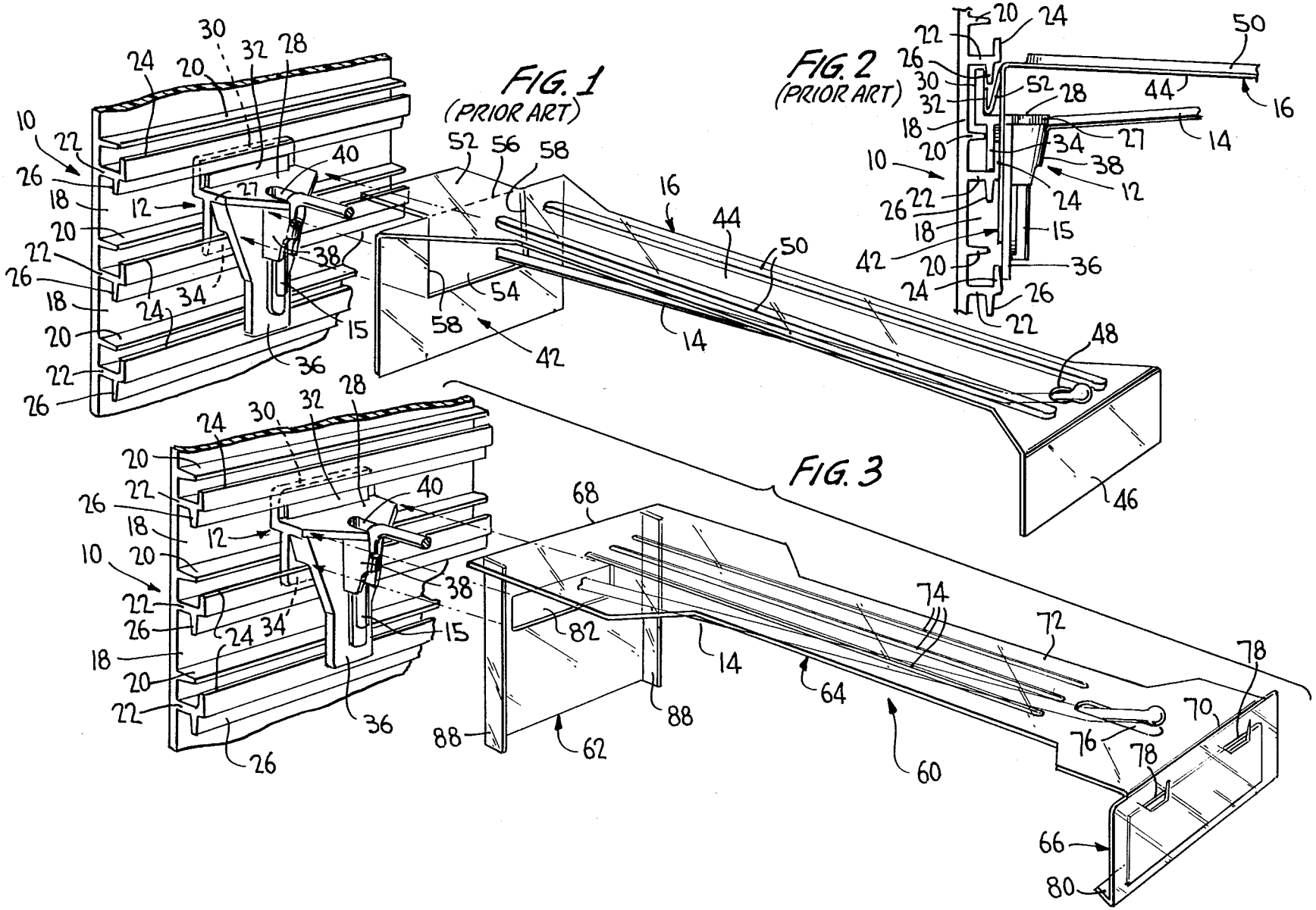
FIG. 1 (PRIOR ART)
FIG. 2 (PRIOR ART)
FIG. 1 is a perspective view of a Snaplock hook and Mini Slat assembly with a known form of product information tag used in combination therewith.
FIG. 2 is a side elevational view of a proximal end portion of the assembly showing the tag attached.
FIG. 3 is a view similar to FIG. 1 wherein a product information tag in accordance with the invention is substituted for the known tag.

Referring initially to FIGS. 1 and 2, there is illustrated an assembly of a Mini Slat wall panel 10, as previously referred to, and a Snaplock hook comprising a molded plastic bracket 12 and a wire rod 14 forming the hook itself. These Figures also show the known form of product information tag 16 previously referred to.

Wall panel 10 is a plastic molding formed with an array of superimposed horizontal channels 18 defined by respective horizontal ribs 20 and 22. Ribs 20 are plain horizontally extending ribs, while ribs 22 have both upwardly and downwardly extending vertical flanges 24, 26 respectively. The flanges 24 are located at the ends of the respective ribs 22 (which are longer than ribs 20), and the flanges 26 are somewhat set back approximately in line with the ends of ribs 20.

Bracket 12 has a horizontal flange 27 with a flat upper surface 28 and an upwardly extending flange 30 at the back of surface 28. Flange 30 has a ridge 32 on its front surface. Below flange 27 and somewhat forwardly of flange 30 is a downwardly extending flange 34. In front of flange 34 and slightly spaced therefrom is an elongate downwardly depending flat handle 36. On the front of the handle, there is a pocket 38 with a vertical through-bore for receiving the back downwardly bent end 15 of rod 14. A recess 40 at the top of the pocket allows rod 14 to sit substantially flush with surface 28.

The product information tag 16 is an elongate strip of plastic of a generally well-known configuration having a fold-down proximal end mounting portion 42 for securing same to the panel 10-bracket 12 assembly, an elongate central body portion 44 for extending over hook 14, and a distal end, fold-down display or label-carrying portion 46. The body portion 44 is formed with an opening 48 for the distal end of hook 14 to extend through in known manner, and with elongate rigidifying ribs 50. The mounting portion 42 is formed with a rectangular flap 52 defining a relatively large rectangular opening 54, the flap hinging about a fold-line 56 which is also the fold-line of the mounting portion, and the flap being about a half of the height of opening 54.

In use, bracket 12 is worked into opening 54, before the bracket is attached to panel 10, such that flange 34 of the bracket fits behind mounting portion 42 while handle 36 fits in front of mounting portion 42. Then, the bracket 12 is fitted into one of the channels 18 of panel 10, so that mounting portion 42 of the tag is trapped between one of the panel flanges 24 and the back surface of handle 36, as seen in FIG. 2. The width of opening 54 is such that its side edges 58 are intended to have a friction fit against the sides of flange 27 of the bracket, with flap 52 frictionally engaging surface 28, so as to hold tag 16 firmly and securely in position over the top of hook 14. In practice, however, it is found that edges 58 of the mounting portion 42 may tend to work forwardly along the edges of flange 27 and over the front of the bracket, somewhat destabilizing the tag so that it may skew lengthwise and possibly become detached from the distal end of hook 14. The invention is intended to improve the mounting of the tag in this respect.

Figures 4, 5, 6, 7, 8:
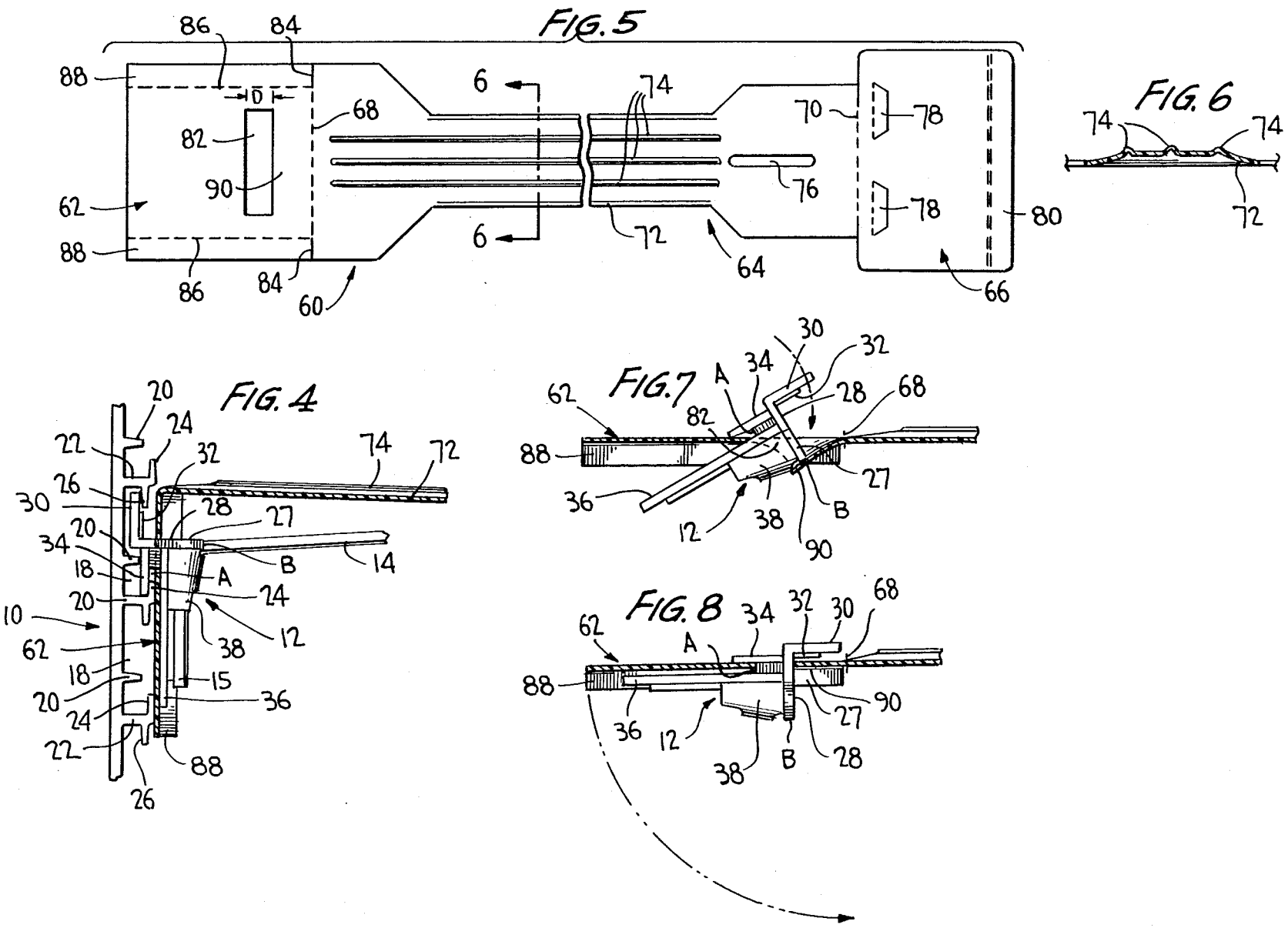
FIG. 4 is a view similar to FIG. 2 but showing the inventive tag attached.
FIG. 5 is a plan view of the inventive tag prior to folding.
FIG. 6 is a sectional view on line 6—6 of FIG. 5.
FIGS. 7 and 8 are elevational views showing the manner of attaching the inventive tag to the bracket of a Snaplock hook.

Turning now to FIGS. 5 and 6 in particular, there is shown a product information tag 60 in accordance with the invention. As previously noted, the tag 60 is formed from an elongate plastic strip and has a proximal end mounting portion 62, an elongate body portion 64 and a distal end display portion 66. The mounting portion and display portion are separated from the body portion by respective transverse fold lines 68, 70 so that they can be folded down at opposite ends of the tag. The body portion has a narrow central section 72 with elongate rigidifying ribs or creases 74 and an opening 76 for the distal end of hook 14 to extend through. This type of body portion is disclosed for example, in my aforementioned U.S. Pat. No. 4,715,135 and its purpose is fully explained therein. The display portion 66 of the tag is provided with cut-out label retaining flaps 78 and a fold-up end rib or shelf 80 useful, for example, to serve as a guide for a bar-code reader.

The mounting portion 62 of tag 60 is provided with a relatively shallow rectangular cut-out, or opening 82 spaced somewhat from fold line 68, the depth of opening 82 being considerably smaller than the depth of the equivalent opening 54 in the previously described tag 16. Mounting portion 62 is further formed with short cuts 84 (a long fold line 68) and lengthwise fold lines 86 which define respective fold-in support flaps or tabs 88 at opposite sides.

To mount tag 60 on bracket 12 in this case, the handle 36 is inserted through opening 82 from behind, see FIGS. 7 and 8, and the bracket is then twisted to force or snap flange 27 through opening 82 with some resilient flexing of the material 90 of the tag which is above opening 82. It is important that the depth of opening 82 should be less than the distance between points A and B on the bracket, point A being a neck formed between flange 34 and handle 36, and point B being the front edge of flange 27. With this dimensioning, when the bracket 12 is pushed fully home into aperture 82 (FIG. 8) and the bracket/hook/tag assembly is attached to panel 10 (FIG. 4), the mounting portion of the tag will not tend to ride forwardly along flange 27, as with the known form of tag, thereby affording a tighter, more secure and stabilized mounting of the tag on the bracket and wall panel.

It will be understood that tab 60 is folded into the configuration shown in FIGS. 3 and 4 for mounting and that the forwardly folded tabs 88 provide additional supports for the mounting portion 72 of the tag. It is further evident that when mounted, the bracket 12 is partially inserted through opening 82 with the lower edge of the opening adjacent neck A and the upper edge of the opening above surface 28.

While only a preferred embodiment of the invention has been described herein in detail, the invention in not limited thereby, and modifications can be made within the scope of the attached claims.

What is claimed is:

1. A product information and display tag for use with a substantially horizontal oriented product suspension hook, the hook having a proximal end bracket for releasably attaching same to a wall panel and the like, said bracket including a horizontal flange having a back edge and a front edge, a depending flange extending from the horizontal flange, a depending handle extending from the horizontal flange forwardly of the depending flange with a neck formed between the handle and the depending flange, and attachment means on the bracket for an elongate product support hook, the tag comprising an elongate flexible sheet having a proximal end mounting portion for attachment to the bracket, an elongate intermediate body portion for extending over the hook, and a distal end display portion for product information, the mounting portion having an opening for receiving the bracket by inserting the handle through the opening and twisting the bracket so that one edge of said opening is located between said depending flange and said handle adjacent the neck and an opposite edge of the opening is located above said horizontal flange, wherein the width of the opening between said edges is less than the distance between said neck and the front edge of said horizontal flange to preclude the mounting portion from working forwardly over the front edge of said horizontal portion when the tag is in use.

2. The invention defined in claim 1 wherein the tag includes a transverse fold line between the mounting portion and the body portion and forwardly foldable edge tabs extending from said fold line to form supports for the body portion of the tag when folded.

3. The invention as defined is claim 1 wherein the body portion of the tag has a narrow central section with lengthwise reinforcing ribbing.

4. The invention as defined in claim 1 wherein the display portion of the tag has means for attaching a product information label.

5. In combination, an elongate product suspension hook and a product information display tag for displaying product information at a distal end of the hook, the hook having a proximal end bracket for releasably securing same on a wall panel or the like, said bracket having a horizontal flange with a front edge and a back edge, an upstanding flange depending from the back edge, a depending flange extending from the horizontal flange, and a depending handle extending from the horizontal flange forwardly of the depending flange with a neck formed between the depending flange and the handle, the tag comprising an elongate sheet of flexible material having a proximal end mounting portion secured to said bracket, an elongate intermediate body portion extending over the hook, and a distal end display portion at the distal end of the hook, the mounting portion and display portion being folded downwardly from the body portion, and the mounting portion having an aperture by which it is mounted on the bracket with the handle inserted through the aperture so that the aperture is located with one edge thereto between the handle and said depending edge, adjacent said neck, and an opposite edge thereof above the horizontal flange, said aperture having a width between said edges which is less than a distance between said back and the front edge of the horizontal flange to preclude the mounting portion from working forwardly over said front edge.

6. The invention defined in claim 5 wherein the mounting portion of the tag has forwardly folded edge tabs for supporting the body portion.

* * * * *